US005387116A

United States Patent [19]

Wang

[11] Patent Number: 5,387,116

[45] **Date of Patent: * Feb. 7, 1995**

[54] AUTO TERMINATION BNC T ADAPTOR

[76] Inventor: Tsan-Chi Wang, 1 Fl., No. 13, Lane 312, Chung Cheng Rd., Hsin Tien, Taipei Hsien, Taiwan, Prov. of China

[ * ] Notice: The portion of the term of this patent subsequent to Jun. 15, 2010 has been disclaimed.

[21] Appl. No.: 85,116

[22] Filed: Jul. 2, 1993

[51] Int. Cl.[6] ..... H01R 29/00

[52] U.S. Cl. ..... 439/188; 439/620; 439/862

[58] Field of Search ..... 439/188, 620–622, 439/582, 579, 510–513, 507, 858, 861, 862

[56] References Cited

U.S. PATENT DOCUMENTS

| | | | |
|---|---|---|---|
| 4,633,048 | 12/1986 | Komatsu | 439/858 |
| 5,108,300 | 4/1992 | Weber | 439/620 |
| 5,219,299 | 6/1993 | Wang | 439/188 |

FOREIGN PATENT DOCUMENTS

| | | | |
|---|---|---|---|
| 0211884 | 7/1909 | Germany | 439/862 |

*Primary Examiner*—Larry I. Schwartz
*Assistant Examiner*—Hien D. Vu
*Attorney, Agent, or Firm*—Bacon & Thomas

[57] ABSTRACT

An improved terminal BNC T Adaptor disclosed herein is featured for having an improved auto termination installation, which comprises of a female contact in connection with a male contact. Extending both outward and downward from the two lateral sides of the female contact is an oblique panel. Prior to connecting the BNC plug, by means of elasticity the panel will get in touch and press onto a conductive element with ceramic resistance to enable the male contact, the female contact, the conductive element and the ceramic resistance to form a noise blocking circuit, so as to achieve the effect of auto termination. On the contrary, after connecting T Adaptor with BNC plug, the panel will be pushed away from the conductive element by the male contact inside the BNC Plug, and thus stop the noise blocking from functioning. The other end of the ceramic resistance is also connected with an improved conductive voltage cover, to the bottom of which a tether is connected by a retention post to achieve a better grounding effect.

4 Claims, 8 Drawing Sheets

AUTO TERMINATION BNC T ADAPTOR

BACKGROUND OF THE INVENTION

The present invention relates to a BNC (bayonet navy connector) T Adaptor which is exclusively used for connecting a computer network. When the adaptor is not connecting with a BNC plug, the effect of auto termination which has an auto noise disturbance blocking function can be achieved by means of a ceramic resistance set in its interior to ensure the quality of network signal.

The BNC T Adaptor has an auto noise disturbance blocking function and is the only one of its kind which is covered under U.S. Pat. No. 5,219,299. Prior to its operation, the adaptor can automatically be conducted with Ceramic Register 6 and conductive plate 5 by means of contact ends 34, 35, of Spring Plate 3 to form a circuit capable of blocking noise disturbance, so as to form a BNC T Adaptor which is only featured for the function of auto termination.

SUMMARY OF THE INVENTION

After using, improvement was found to be necessary for the known BNC T Adaptor to have the function of auto termination because the pressure needed for the aforementioned contact ends 34, 35 to contact the conductive plate 5 has to be provided by two counter-folding chips 32, 33, which are made by large angle counter-folding and will soon become fatigued after having been used for several times, and thus cause poor contact between contact ends 34, 35 and conductive plate 5. This will not only affect its effective service life, but will also affect its function of auto termination.

On the other hand, the present invention also provides an improved conductive voltage cover. Besides conducting the ceramic resistance to form a noise blocking circuit, it also has a retention post which is tightly inserted into the bottom of the conductive voltage cover. The retention post may also be used to connect with a grounding chain to strengthen the grounding effect of BNC T Adaptor. In addition, a retention ball chain can also be connected for fixing the elements.

BRIEF DESCRIPTION OF THE DRAWINGS

In respect of the technical contents and preferred embodiments of the present invention, a brief description is hereby made in coordination with the diagrammatic drawings set below.

DETAILED DESCRIPTION OF THE PREFERRED EMBODIMENTS

Figure 1:
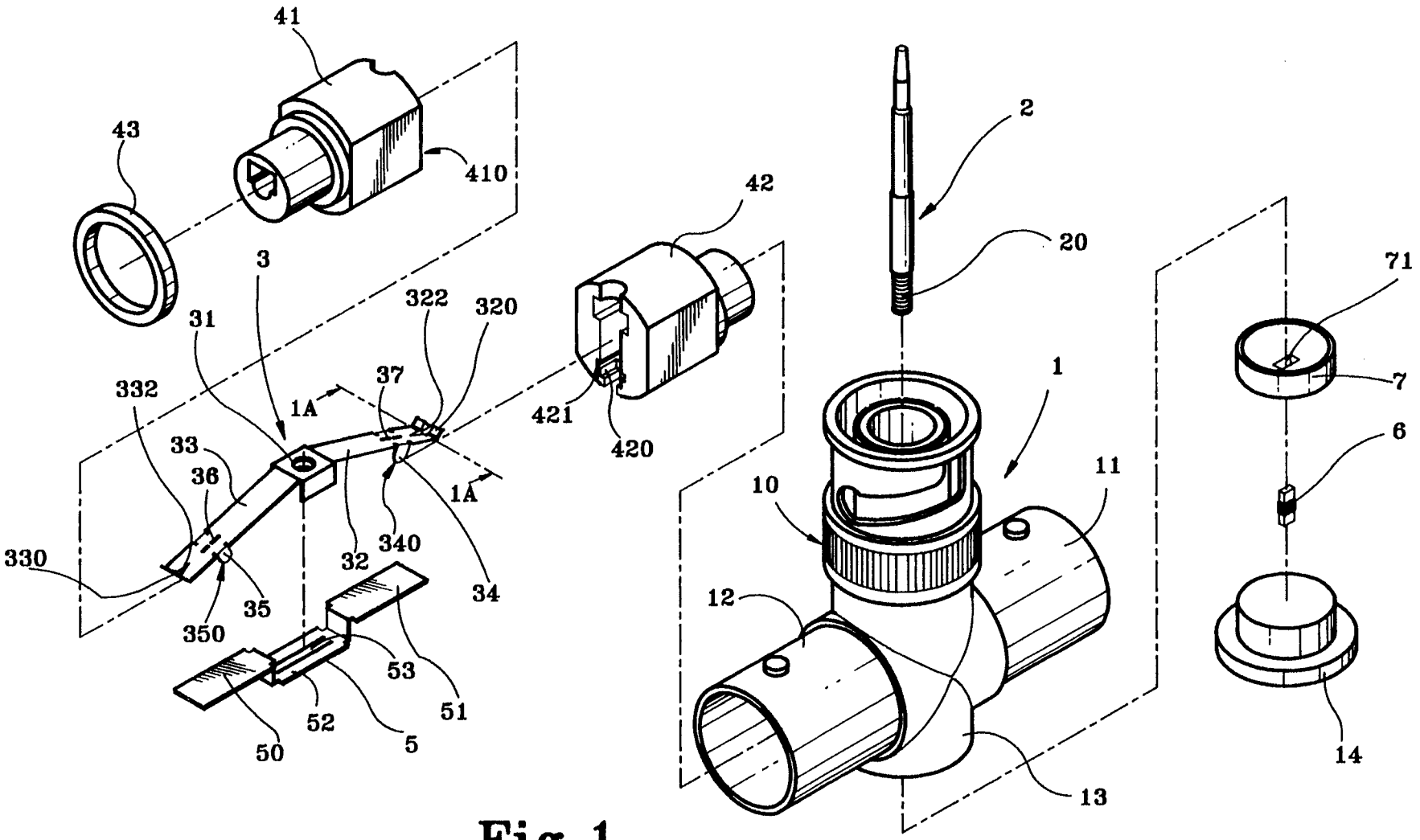
FIG. 1 is an exploded perspective view of the present invention.
Figure 1A:
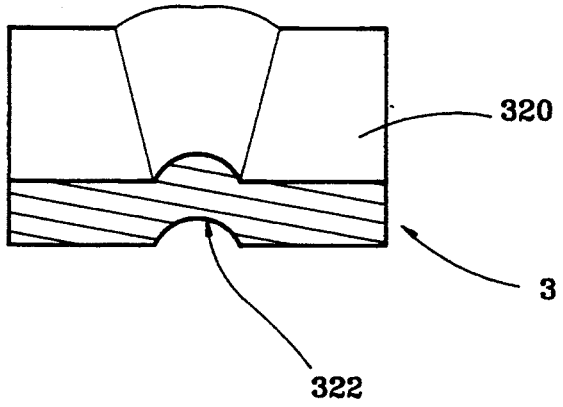
FIG. 1A is a partial, sectional view of the guiding plane at the extreme end of the Female Contact, which indicated an arc-shaped section with a downward-facing opening.
Figure 3:
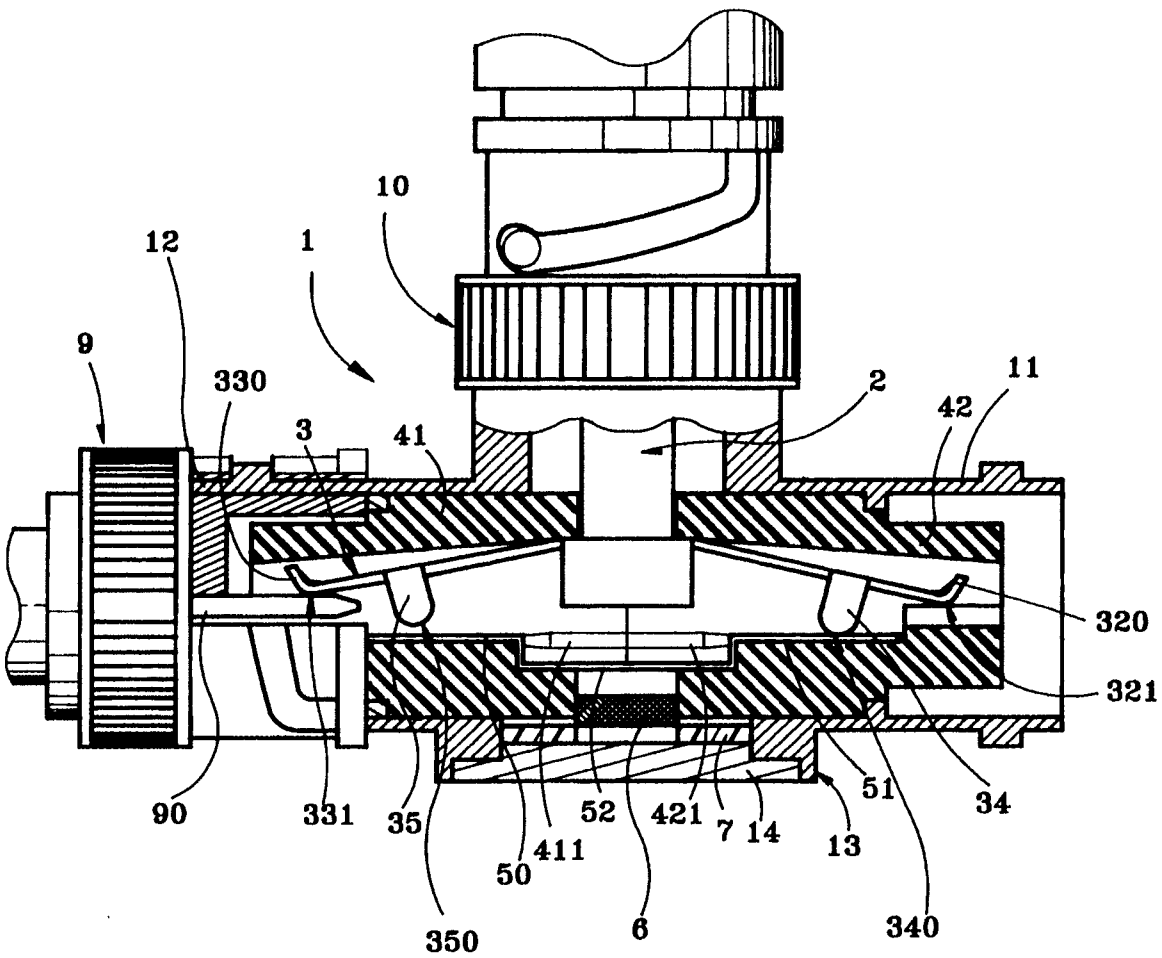
FIG. 3 is a cross-sectional view of FIG. 2, which indicates the connecting relationship of the present invention with the BNC Plug.
Figure 8A:
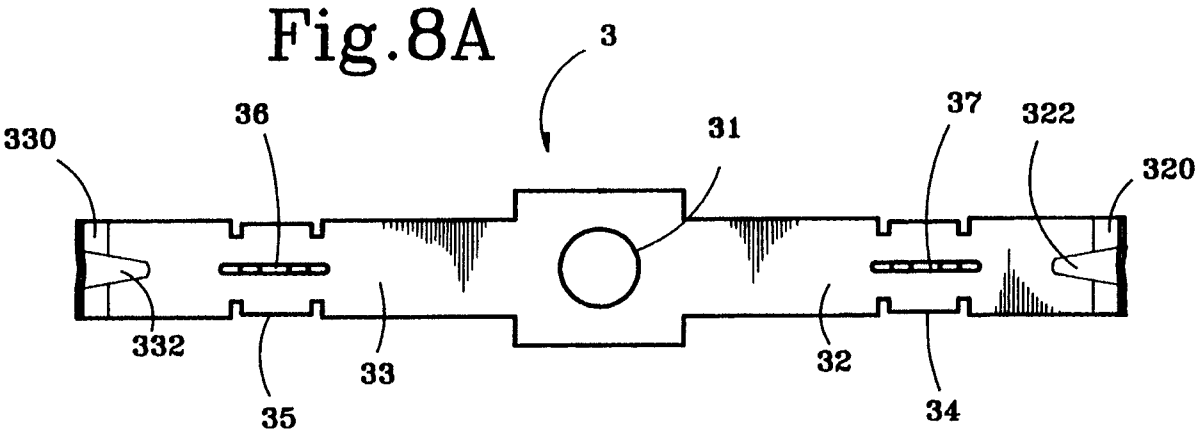
FIG. 8A is a top view of the female contact of the present invention.
Figure 8B:
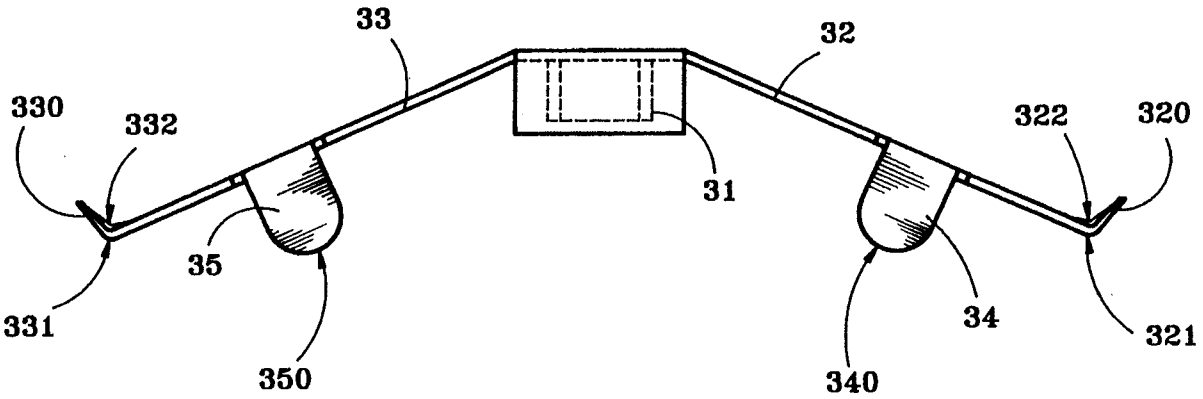
FIG. 8B is a side view of the female contact of the present invention.
Figure 8C:
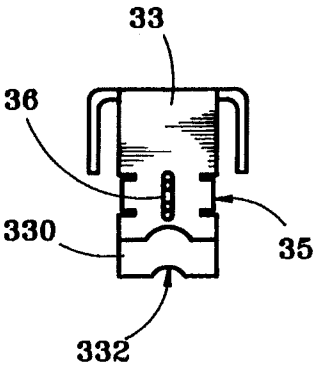
FIG. 8C is an end view of the female contact of the present invention.

Please refer to FIG. 1, from which it can be seen that BNC T Adaptor is having a vertical revolving cap 10 and two horizontal BNC Jack 11, 12, of which revolving cap 10 is used for connecting the computer network adaptor. As indicated in FIG. 3, BNC jack 11, 12 may selectively connect with one or two BNC plug 9 which is in connection with other computer to complete a network interfacing process. Therefore, network signals can be transmitted through male contact 2 of adaptor 1, female contact 3 which connects with male contact 2 and male contact 90 inside BNC Plug 9 to the computer in connection. To prevent female contact 3 from getting in touch with the metallic shell body for grounding purpose, as indicated in FIG. 1, female contact 3 is wrapped up by insulators 41, 42 before being put into the interior of BNC jack 11, 12. Finally, insulators 41, 42 will be fixed in the interior of BNC jack 11, 12 by a packing ring 43. The disclosure hereof indicates the basic know-how and structure of a BNC T Adaptor 1. While the improvement made by the present invention is related to the auto termination device formed by female contact 3 and related elements. A further description and preferred embodiments are made as follows:

Please refer to FIGS. 1 and 8. Female contact 3 is a metallic piece made through punching, folding and electroplating processes, of which the central part has a hole-shaped socket 31 into which male contact 2 can be housed. Only female thread is available in the interior of socket 31 for connecting with male thread 20 which is set at the bottom end of male contact 2. In addition, the interior wall of socket 31 can be made with a smooth surface for the connecting of male contact 2, which has an inverted-hook shaped nonreturn joining bolt 21. Such a tightly matched male contact 2 is found to be easier in assembling, and can also achieve the effect of not falling off.

Extending outward from the two lateral sides of sockets 31 are wing panels 32, 33, which are folded in a slightly downward oblique extension with their extreme ends folded in an upward counter-direction to form oblique guide planes 320, 330. The counter-folding points 321, 331 have arc-shaped sectional planes 322, 332 with a downward opening. Therefore, when connecting with BNC plug 9 (refer to FIG. 3), the tip of male contact 90 will be inserted toward the lower direction of wing panel 33 under the guidance of guide planes 320, 330 to keep a sound contacting relationship by means of the arc-shaped sectional plane 322 of counter-folding point 321.

On each of wing panels 32, 33 lying in between guide planes 320, 330, there are a pair of contact feet 34, 35 facing one another and extending downward. The contact points 340, 350 at the bottom end of contact foot 34, 35 should be connected to a level which is slightly lower than that of counter-folding points 321, 331 to enable it to get in touch with conductive element 5 which comprises a ceramic resistance 6 under a normal condition so as to form a noise blocking circuit to get rid of noise disturbance. Contact feet 34, 35 are formed by having them bent downward from the two lateral sides of wing panel 32, 33. In order not to avoid affecting the strength of wing panel 32, 33 herein, wrinkled/folding planes 36, 37 will have to be formed by punching at the space lying in between contact feet 34, 35 which face one another, so as to herein strengthen the anticurving strength of wing panel 32, 33.

Conductive element 5 is a metallic piece which is also formed by punching, bending and electroplating processes. It has an inverted contact part 52 as well as guide pieces 50, 51 which extend horizontally from contact part 52 toward the two lateral sides in such a way that contact part 52 can exactly be housed into a crevice which is formed by housing grooves 410, 420 at the bottom edge of insulators 41, 42, so as to achieve the effect of positioning. A bridge-type spring piece 52 which is punched at the central of the contact part will thus achieve a comparatively better contact relationship with ceramic resistance 6. Guide piece will be inserted and fixed therein through passages 411, 412 at the bottom edge of two parallel insulators 41, 42. Guide piece 50, 51 also have a length which is long enough to keep it in touch with contact feet 34, 35.

Figure 2:
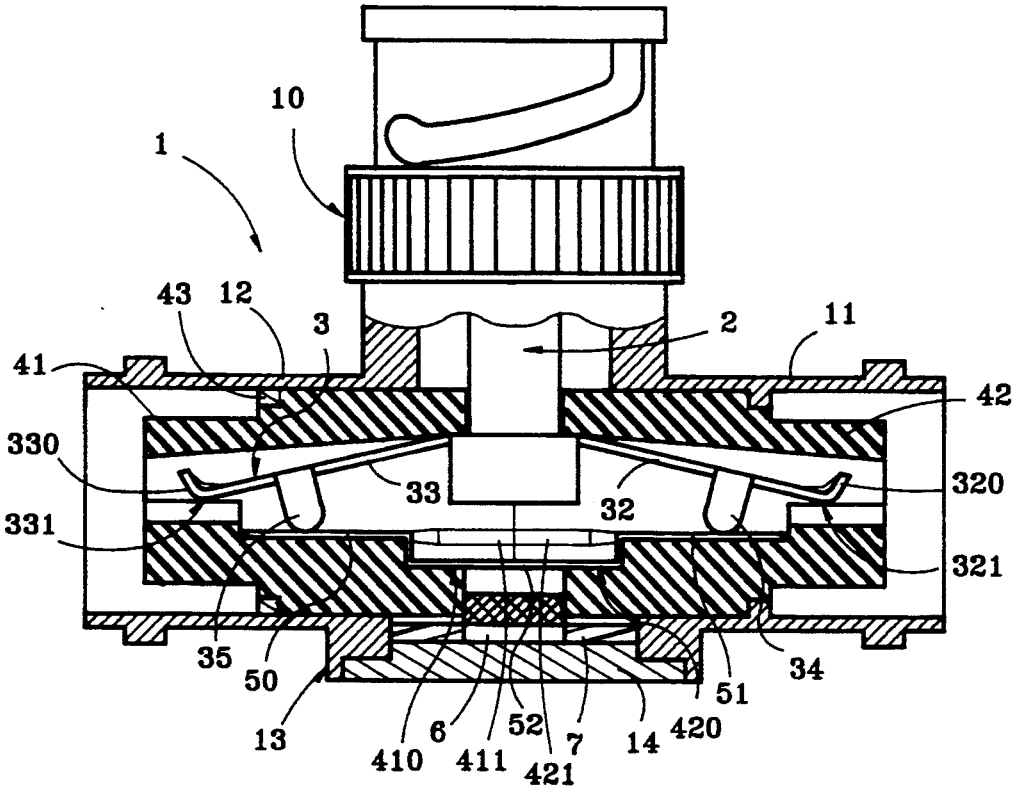
FIG. 2 is a cross-sectional view of FIG. 1 of the present invention.

Finally, an insulating seat 7 and a micro ceramic resistance 6 which can pierce exactly into fixing hole 71 will be put according to the right order into neck 13 at the bottom end of adaptor 1, and will be further tightly sealed within neck 13 by conductive voltage cover 14. Whereby it can be seen from FIG. 2 that male contact 2, female contact 3, conductive element 5, ceramic resistance 6 and conductive voltage cover 14 will all be conducted to become a noise blocking circuit to present a BND C Adaptor with auto termination under a normal condition. And as indicated by FIG. 3, after any BNC Jack 11 or 12 of adaptor 1 is connected with a BNC plug, another male contact 90 which is inserted will push wing panel 33 upward to cause contact foot 3 to move away from guide piece 50, and thus get rid of the aforementioned function of auto termination. Of course, another wing panel 32 which is not connected with BNC plug will maintain the function of auto termination under normal conditions to prevent the disturbance of external noise.

After drawing out the aforementioned BNC plug 9, contact foot 35 will recover its contacting relationship with piece 50 by the springing force of wing panel 33 which is produced when bending downward. By comparing wing panels 32, 33 which are slightly bending with the prior art, it can be seen that elasticity fatigue will not so easily be found in the former.

Figure 4:
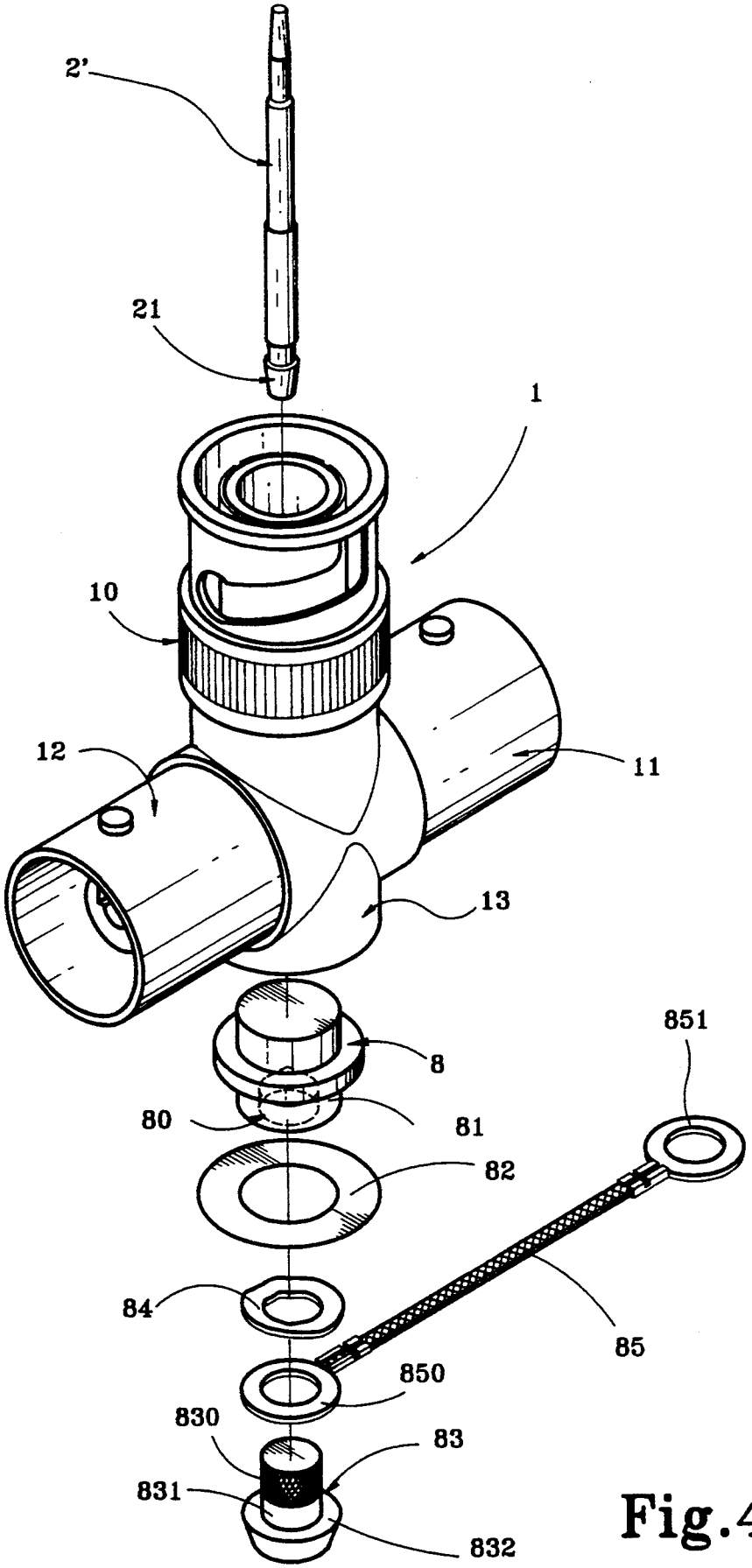
FIG. 4 is an exploded perspective view of another preferred embodiment of the present invention, which indicates the assembling relationship of the Grounding Chain, Retention Post, the Conductive Voltage Cover and the Male Contact.
Figure 5:
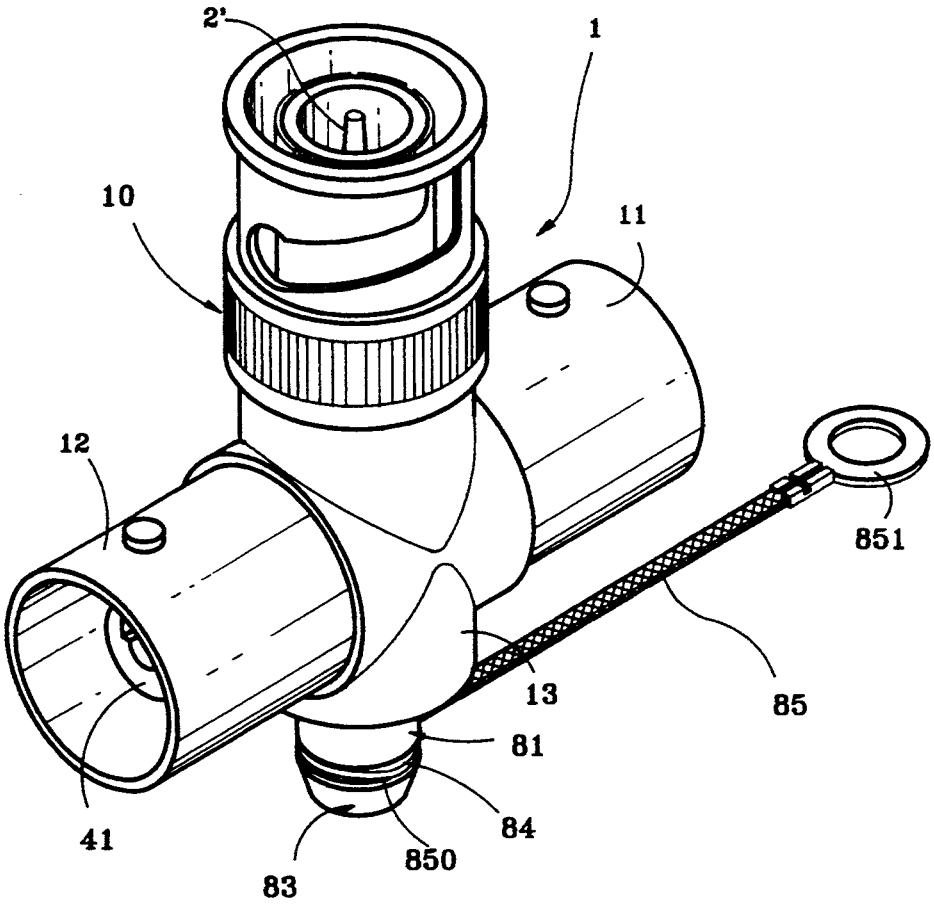
FIG. 5 is a perspective view of FIG. 4 of the present invention.
Figure 6:
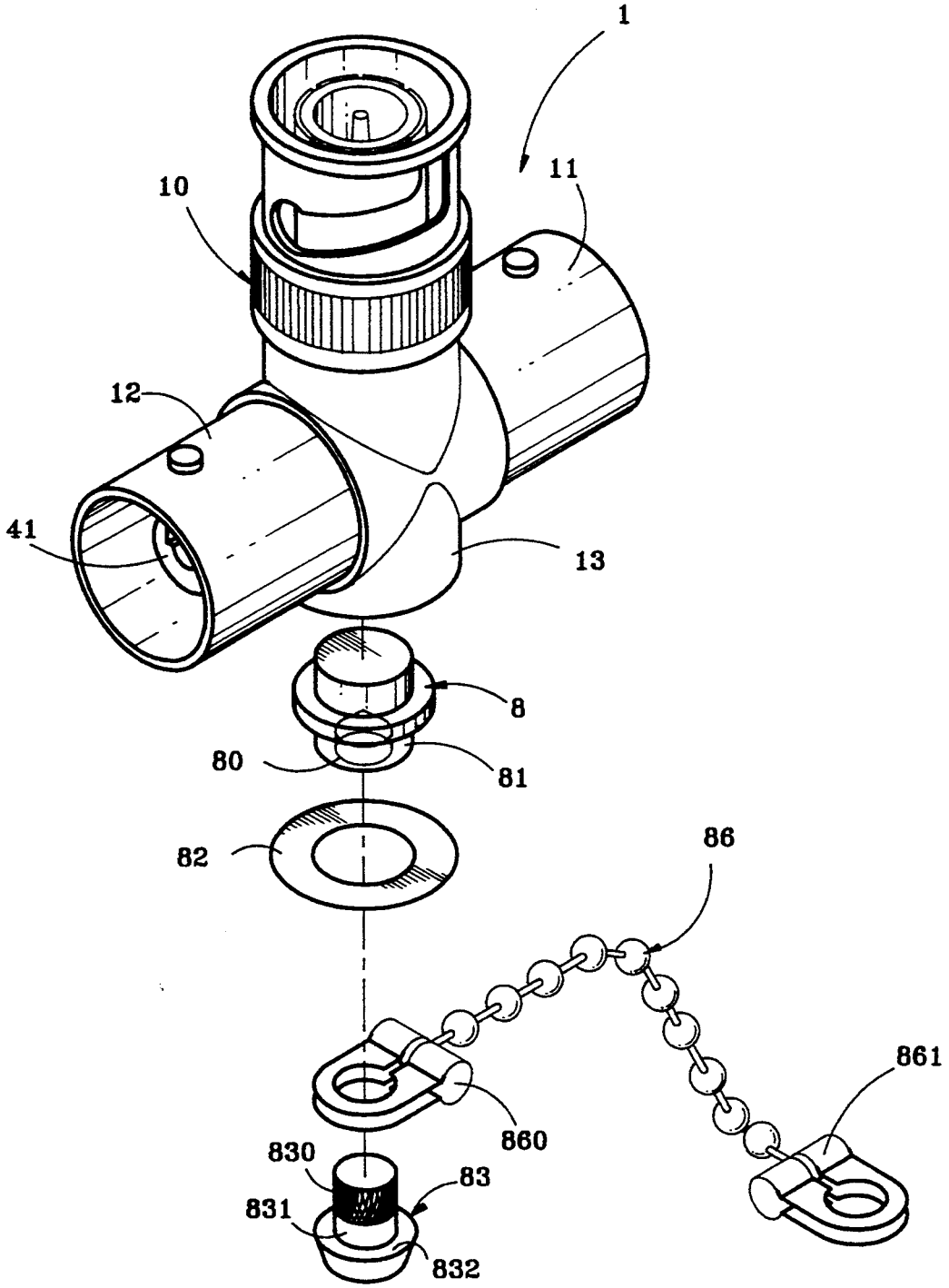
FIG. 6 is a perspective, partially exploded view of the present invention in which bead-chains are being used.
Figure 7:
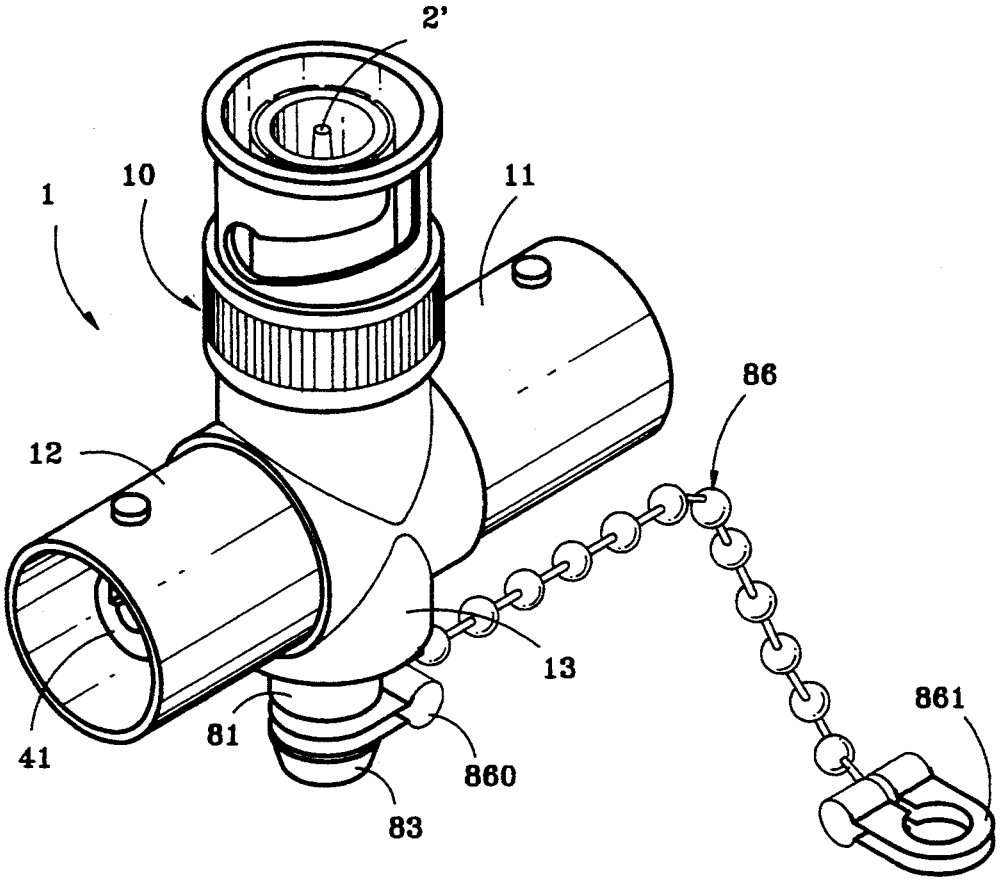
FIG. 7 is a perspective view of FIG. 6 of the present invention.

The conductive voltage cover 14 mentioned above is made of know-how covered under the aforementioned U.S. Patent. However, another improved conductive voltage cover 8 will be disclosed herewith. As shown in FIG. 4, the difference between voltage cover 8 and the aforementioned voltage cover 14 lies in the design in which the bottom end of voltage cover 8 has a bolt hole 80 as well as a cylindrical shaped outer wall 81 which extends downward from bolt hole 80. An annular specification indication plate 82 can be fixed on the exterior of cylindrical outer wall 81 on which the resistance value and other related data of the aforementioned ceramic resistance 6 will be indicated. Therefore, a change may be indicated by replacing the indication plate at anytime, even though there is a change in the resistance value. And thus ensures better changeability.

A retention post 83 with an embossed end 830 is tightly inserted into bolt hole 80, and the smooth neck 831 may connect with an arch-shaped washer 84 and grounding chain 85. By means of the pressure exerted by washer 84, the connecting ring 850 of grounding chain 85 will be able to keep a sound contacting relationship with the hat section 832 of retention post 83, and can revolve at will. Connecting ring 851 is fixed at the other end of grounding chain 85 onto an appropriate location to strengthen the grounding effect of BNC T Adaptor. It would be preferable that weaving textured Tether Chain be adapted for grounding chain 85.

Besides connecting grounding chain 85, the neck 831 of retention post 83 may also be used to connect retention chain 86 for fixing purpose. Upon using retention chain 86, owing to the fact that an outwardly extending springing force is available with locking piece 860, 861 at its two ends, therefore, a sound contacting relationship can be kept with hat section 832 and revolve freely without using arch-shaped washer 84.

Summarizing the above, one can realize that the female contact provided by the present invention can offer a much longer effective service life. While the improved conductive voltage cover can also provide more selective functions to strengthen the function of T Adaptor. Therefore, after understanding the know-how and the preferred embodiment of the present invention, any of the changes which are simple and of similar nature should be regarded as being covered under the technical area of the present invention.

I claim:

1. An auto termination BNC T adaptor, comprising:

a) a housing having BNC jacks;

b) a male contact having connection means on a bottom portion extending into the housing;

c) a female contact located in the housing and attached to the bottom portion of the male contact by the connection means, the female contact having a socket and wing panels which extend obliquely downward from two lateral sides of the socket, each wing panel having an oblique guide plane counter-folded at an extreme end thereof, and also having an arc-shaped section defining a downward facing opening located on counter-folding points of the guide plane;

d) a pair of contact feet facing one another and extending downwardly from each of the wing panels between the socket and the guide plane, the contact feet defining contact points which extend below a line connecting the two counter-folding points;

e) a conductive element located in the housing having a contact section and conductive pieces extending outward from two lateral sides of the contact section;

f) a ceramic resistance in electrical contact with the contact section of the conductive element;

g) insulation means located in the housing so as to electrically insulate the housing from the male and female contacts, the conductive element and the ceramic resistance; and, h) a conductive voltage cover located in a bottom of the adapter so as to be in contact with the ceramic resistance.

2. An auto termination BNC T adaptor as described in claim 1, in which the connection means comprises a male thread formed on the bottom portion of the male contact.

3. An auto termination BNC T adaptor as described in claim 2, further comprising a female thread formed on the socket of the female contact for the attachment of the male thread at the bottom portion of the male contact.

4. An auto termination BNC T adaptor as described in claim 1, in which the wing panels of the female contact define a wrinkled/folding plane for strengthening purpose located in the space between the pair of contact feet which are facing one another on the wing panel.

* * * * *